US005779111A

United States Patent [19]

Ball

[11] Patent Number: 5,779,111

[45] Date of Patent: Jul. 14, 1998

[54] TRAVEL HANGER

[76] Inventor: Norman H. Ball, 12720 Grandview, Overland Park, Kans. 66213

[21] Appl. No.: 832,224

[22] Filed: Apr. 3, 1997

Related U.S. Application Data

[63] Continuation of Ser. No. 584,387, Jan. 11, 1996.

[51] Int. Cl.[6] ..... A47G 25/54; A47G 25/36

[52] U.S. Cl. ..... 223/87; 223/85

[58] Field of Search ..... 223/85, 92, 87, 223/88, 98

[56] References Cited

U.S. PATENT DOCUMENTS

| | | | |
|---|---|---|---|
| 1,797,364 | 3/1931 | Porter | 223/87 |
| 1,951,985 | 3/1934 | Likly | 223/18.6 |
| 2,001,624 | 5/1935 | Moore | 206/7 |
| 2,169,552 | 8/1939 | Bellin | 223/68 |
| 2,558,082 | 6/1951 | Goldsmith | 223/98 |
| 2,578,741 | 12/1951 | Reiver | 223/98 |
| 2,622,775 | 12/1952 | Sasaki | 223/98 |
| 2,841,316 | 7/1958 | Johnson | 223/98 |
| 3,865,235 | 2/1975 | Levy | 206/278 |
| 4,944,417 | 7/1990 | Datlow | 223/87 |
| 5,027,945 | 7/1991 | Wilkins | 206/278 |
| 5,127,559 | 7/1992 | Freer et al. | 223/85 |
| 5,413,301 | 5/1995 | Cadman | 248/340 |

FOREIGN PATENT DOCUMENTS

| | | | |
|---|---|---|---|
| 1558160 | 3/1968 | France | 223/87 |

*Primary Examiner*—Bibhu Mohanty
*Attorney, Agent, or Firm*—Chase & Yakimo

[57] ABSTRACT

A travel hanger including a hanger support member adapted for hanging a garment therefrom, including a central hook member and a first and second supporting arm. The arms extend oppositely outwardly from the hook member and are adapted to suspend a garment therefrom. A first sheet is securely attached to the hanger's support across its arms and extends from the arms opposite the hook member. The sheet is intermediate first and second fabric layers of the garment upon the garment being suspended from the arms. A second sheet is removably attached to the hanger support at its hook member, and the sheet extends therefrom adjacent the first sheet with at least one of the fabric layers of the garment therebetween.

15 Claims, 3 Drawing Sheets

Fig. 1
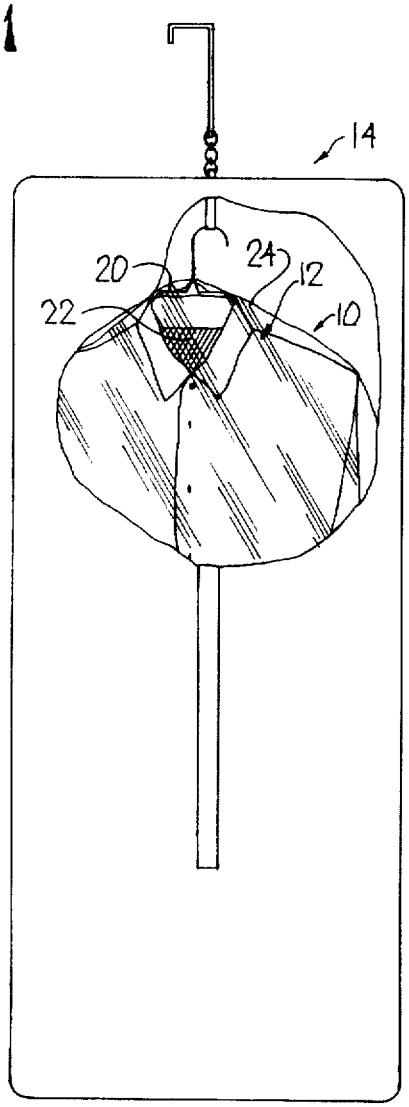
Fig. 2
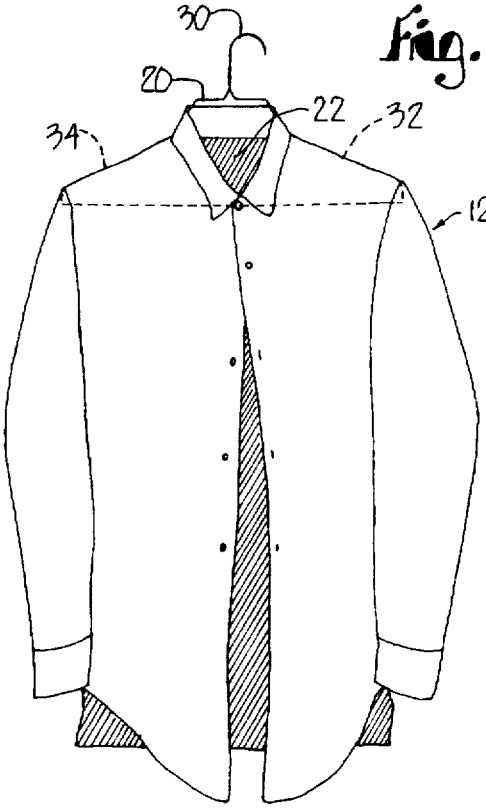
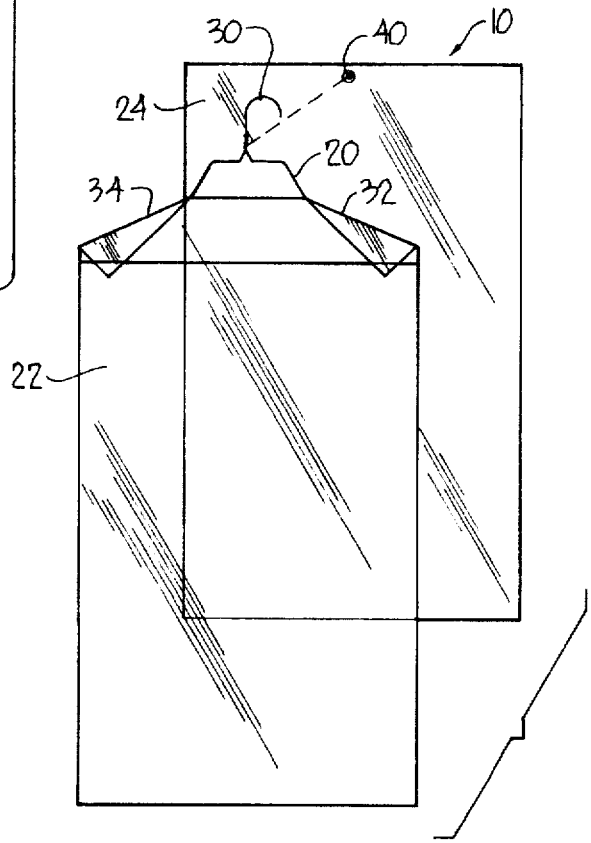
Fig. 3

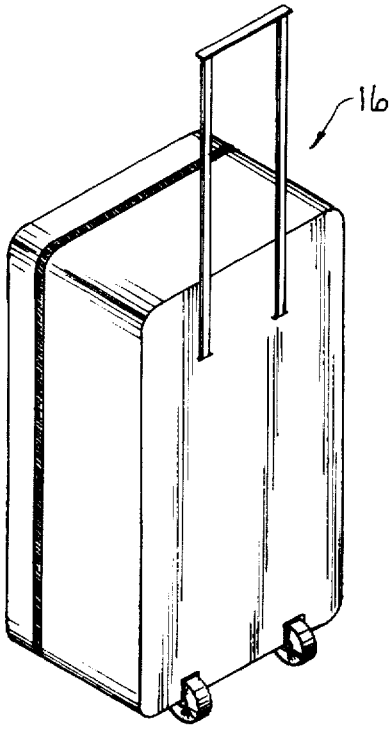
Fig. 4
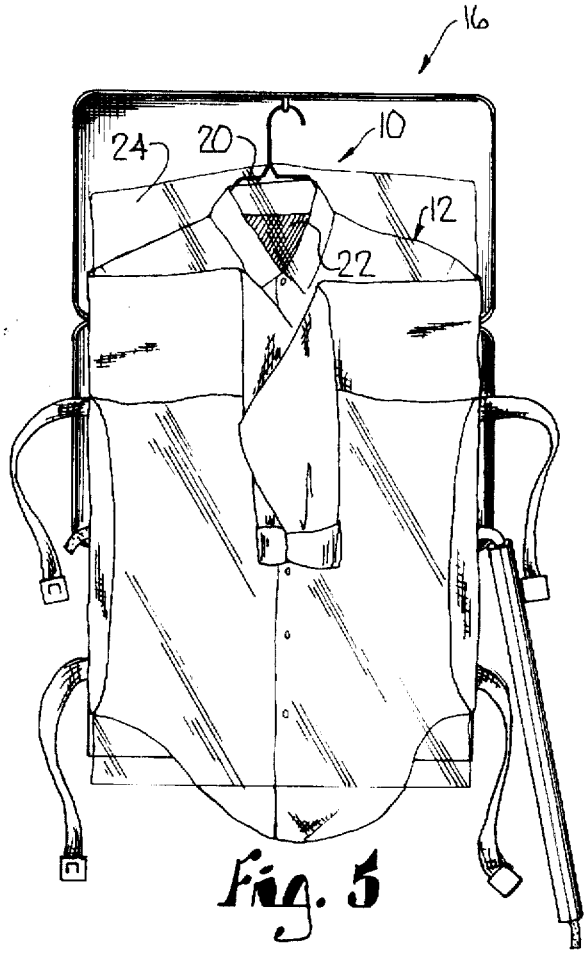
Fig. 5
Fig. 6
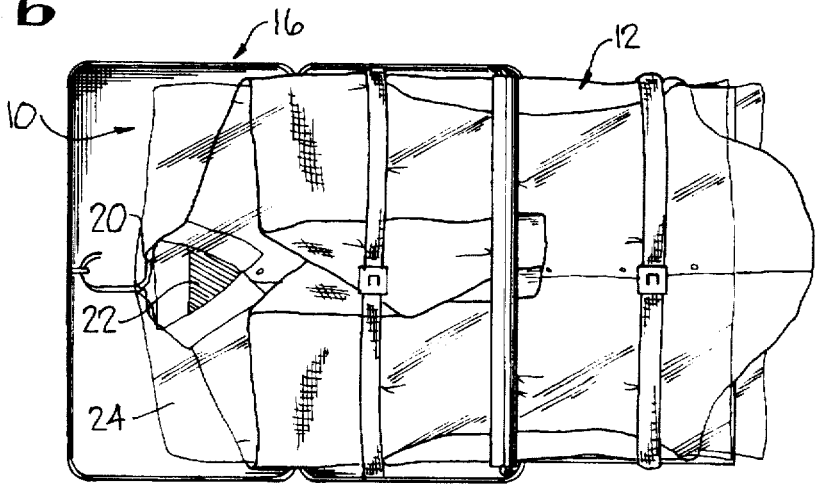

TRAVEL HANGER

This application is a continuation of application Ser. No. 08/584,387, filed Jan. 11, 1996.

FIELD OF THE INVENTION

This invention relates to a hanger assembly which prevents garments from wrinkling when packed for traveling. More specifically, the hanger lines the interior surfaces of a garment as well as any exterior surface thereof that would otherwise contact a next adjacent garment or an interior luggage surface.

BACKGROUND OF THE INVENTION

Various techniques are known that decrease the wrinkling of packed garments; however, none are known to be totally successful. For instance, packing garments in a rolled configuration eliminates only some wrinkling. Furthermore, men's shirts may be folded and boxed instead of hung. Although the boxing eliminates some wrinkling, it causes fold lines.

Garment devices have been disclosed as packing aids. These also do not adequately eliminate wrinkling and can be too cumbersome and heavy for use during travel. Furthermore, they may not be usable with garment bags and carry-on luggage that have become popular and common today.

SUMMARY OF THE INVENTION

Accordingly, a primary object of the subject invention is to provide a travel hanger which prevents wrinkling of the garment hung thereon having a first sheet securely attached to the hanger across the hanger's arms and depending therefrom and a second sheet removably attached to the hanger's hook member and depending therefrom adjacent the first sheet member.

Another object of the subject invention is to provide a travel hanger which prevents the garments hung thereon from wrinkling by preventing the interior surfaces of the garment from contacting one another and the exterior surfaces of the garment from contacting a next adjacent garment packed therewith or an interior luggage surface.

Yet another object of the subject invention is to provide a travel hanger system designed to allow a traveler to pack enough clothes to last the traveler through a work week.

Still a further object of the subject invention is to provide a travel hanger which is very lightweight and does not add substantially to the weight of the traveler's luggage.

Yet a further object of the subject invention is to provide a travel hanger that does not substantially decrease the volume of the traveler's luggage.

Still a further object of the subject invention is to provide a travel hanger that is easy and inexpensive to manufacture.

These objects are attained by providing a travel hanger including a hanger support member adapted for hanging a garment therefrom. The support member has a central hook member and a first and second supporting arm. The arms extend in opposed directions from the hook member and are adapted to suspend a garment therefrom. A first sheet is securely attached to the hanger's support member across its arms and extends from the arms downwardly or oppositely from the hook member. The first sheet is intermediate first and second fabric layers of the garment upon the garment being suspended from the arms. A second sheet is removably attached to the hanger support at its hook member and extends therefrom adjacent the first sheet with at least one of the fabric layers of the garment therebetween. These sheets are preferably formed of thin, transparent flexible plastic and have a length substantially equal to the garment's length.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a front view of a garment bag partially broken away to show the garment packed therein on a travel hanger in accordance with the present invention;

FIG. 2 is a front view of a garment of FIG. 1 with the second sheet of the travel hanger removed therefrom;

FIG. 3 is an exploded view of a travel hanger in accordance with the present invention;

FIG. 4 is a perspective view of carry-on luggage typically used with a travel hanger;

FIG. 5 is a top view of the luggage of FIG. 4 opened to show a garment as it is packed and stored on a travel hanger within the luggage;

FIG. 6 is a top view of the luggage and garment of FIG. 5 fully packed and secured within the luggage of FIG. 4.

DETAILED DESCRIPTION

Figure 7:
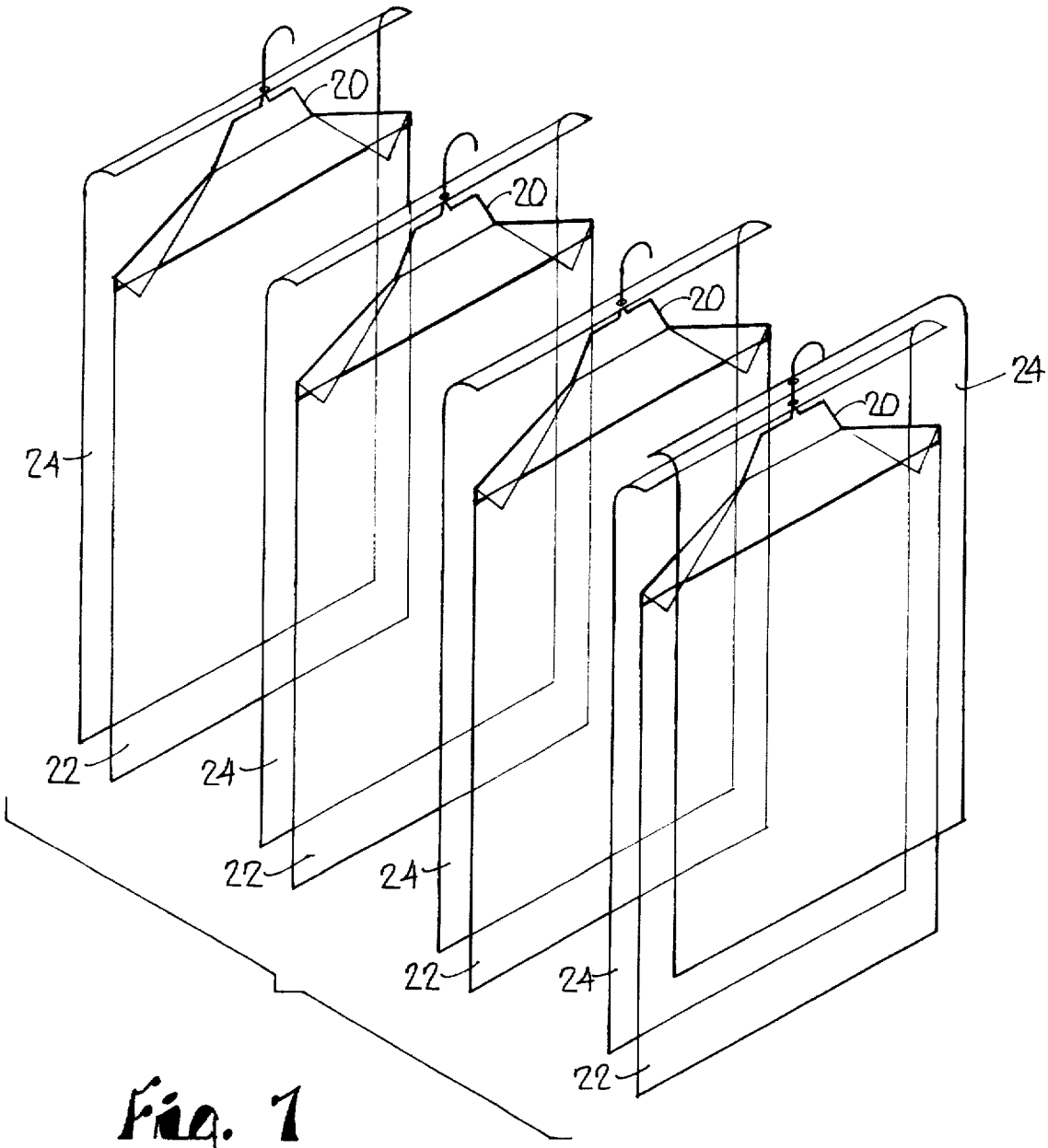
FIG. 7 is perspective view of a travel hanger system in accordance with the present invention which allows the traveler to pack for a work week.

Travel hanger 10, as shown in FIG. 3, prevents the wrinkling of a garment 12 hung therefrom when packed in luggage, such as garment bag 14 or Rollaboard® type luggage (sold by Travel-Pro) 16, during travel, as shown in FIGS. 1 and 6, respectively. Wrinkling is substantially eliminated because hanger 10 prevents the garment's interior surfaces from contacting one another, as shown in FIG. 2, and prevents the garment's exterior surface from contacting any next adjacent garment's exterior surface and/or an interior luggage surface, as shown in FIGS. 1, 5 and 6.

Travel hanger 10 includes hanger support member 20, first sheet 22 and second sheet 24, as seen in FIGS. 1–3, 5 and 6. Hanger member 20 supports garment 12 and presents a lightweight frame, preferably formed of metal, rigid plastic or wood, from which first sheet 22 hangs. Hanger member 20 includes a central hook member 30 and a first and second supporting arm 32 and 34, as best seen in FIG. 3. Arms preferably have a width or span of 18 inches to accommodate men's dress shirts as seen in FIGS. 1–2 and 5–6. Of course, such hangers can accommodate various types of garments, including men's shirts, women's blouses and dresses.

Arms 32 and 34 extend oppositely outwardly from hook member 30 and are adapted to extend into the garment's sleeves. See FIGS. 2 and 3. Hook member 30 extends upwardly and outwardly from the junction of arms 32 and 34 for anchoring the travel hanger 10 within garment bag 14, as in FIG. 1, or in Rollaboard® 16, as in FIG. 6.

First sheet 22 is rectangularly shaped and is securely bonded, preferably by adhesive or heat bonding, to hanger member 20 across its arms 32 and 34, as best seen in FIG. 3. First sheet 22 extends outwardly and downwardly from arms 32 and 34, opposite hook member 30. One of sheet's upper corners fold over each one of arms 32 and 34 since arms preferably angle slightly downwardly from the neck of hook member 30.

Second sheet 24 is also rectangularly shaped and includes an attachment aperture 40 for removably attaching second sheet 24 to hanger member 20 around hook member 30, as seen in FIG. 3. Thus, second sheet 24 extends outwardly and downwardly from the neck of hook member 30 adjacent arms 32 and 34 and first sheet 22.

Sheets 22 and 24 are both preferably formed of thin, lightweight, flexible, transparent and slick plastic such as polyethylene. Sheets 22 and 24 are also preferably shaped identically and have a width substantially equal to the width of hanger member 20 and a length substantially equal to the length of the garment hung on hanger 10. As seen in FIGS. 1–2 and 5–6, sheets 22 and 24 have a width equal to 19 inches and a length substantially equal to the length of a man's dress shirt, approximately 34 inches. Sheets 22 and 24 preferably have identical dimensions to facilitate the manufacturing of travel hanger 10 and do not have a thickness greater than 3 millimeters. Thus, hanger 10 occupies very little volume of garment bag 14 or Rollaboard® 16.

A set of travel hangers 10, as seen in FIG. 6, is used for longer trips. Such a set preferably includes four travel hangers 10 with an extra or fifth second sheet 24. This allows a business traveler four clean shirts to be worn throughout the work week.

In use, garment 12 is hung on hanger member 20 with first sheet 22 extending at least substantially between the interior surfaces of the chest and torso portions of garment 12, as seen in FIG. 2. In other words, first sheet 22 is intermediate the back and front fabric layers of garment 12. Second sheet 24 is placed over the front and rear exterior surface of garment 12 by inserting hook member 30 through attachment aperture 40, as seen in FIGS. 1 and 5–7. Thus, a fabric layer of garment 12 extends between first and second sheets 22 and 24. Hook member 30 is secured to garment bag 14 or Rollaboard® 16 in the conventional manner, as shown in FIGS. 1, 5 and 6. Sheets 22 and 24 are easily adjusted to neatly pack garment 12 within garment bag 14 or Rollaboard® 16 since they are flexible, lightweight and transparent. When using Rollaboard® 16, sleeves are preferably folded as shown in FIGS. 5 and 6.

Garment 12, as placed and secured by buttoning or zipping on the travel hanger 10, has the majority of its surface area that typically contacts itself or an adjacent garment covered by either first sheet 22 or second sheet 24. This allows packed garments to respond to packing pressures more freely, thereby reducing wrinkling during travel.

Furthermore, even a set of travel hangers 10, as seen in FIG. 7, is very lightweight and does not exceed 4 ounces. The volume occupied by such a set within luggage, such as Rollaboard® 16, is less than 6 cubic inches and thus, allows the traveler to take advantage of a substantial amount of the Rollaboard®'s packing space. Also, travel hanger 10 is obviously very flexible and is easily adjustable within garment bag 14 or Rollaboard® 16 due to the design of individual sheets 22 and 24. Of course, sets of travel hangers are infinitely expandable. A traveler's only limitation results from the limited space within the luggage.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A travel hanger comprising:

a central hook member;

first and second support arms extending in opposed directions from said hook member for suspending a garment therefrom;

a first sheet of flexible material depending from said support arms, said first sheet intermediate first and second fabric layers of the garment upon the garment being suspended from said support arms to substantially prevent the layers from contacting one another;

a second sheet of flexible material depending from said hook member and adjacent said first sheet with at least one of the fabric layers of the garment therebetween to substantially prevent the fabric layer from contacting any other surface, said sheets having a length substantially equal to the garment's length;

said flexible material adapted to adjust with movement of the garment, said flexible material being at least as flexible as the garment.

2. A travel hanger as claimed in claim 1, wherein said sheets are formed of transparent plastic.

3. A travel hanger system comprising:

a plurality of hanging members, each said member adapted to hang a garment therefrom;

said members each including a hook member for securing said corresponding hanging member to a support, a first flexible sheet adapted to be positioned within the supported garment to substantially prevent the garment's fabric layers from contacting one another and a second flexible sheet adapted to depend from said hanging member adjacent its corresponding first sheet with a fabric layer of the supported garment therebetween to substantially prevent the fabric layer from contacting another layer;

said sheets extending from said corresponding hanging member for a length substantially equal to the garment's length;

said sheets adapted to adjust with movement of the garment, said sheets being at least as flexible as the garment.

4. A travel hanger as claimed in claim 1, further comprising:

a third sheet of flexible material depending from said hook member for a length substantially equal to the garment's length and adjacent said first sheet with another one of the fabric layers of the garment therebetween to substantially prevent the fabric layer from contacting any other surface.

5. A travel hanger system as claimed in claim 3, wherein each of said second sheets are releasably attachable to said corresponding hanging member.

6. A travel hanger as claimed in claim 3, wherein a second sheet of a second hanging member is adjacent a first sheet of a first hanging member, with a fabric layer of the supported garment of said first hanging member therebetween.

7. A travel hanger system as claimed in claim 6, wherein a second sheet of a third hanging member is adjacent said first sheet of said second hanging member with a fabric layer of a supported garment of said second hanging member therebetween.

8. A travel hanger system as claimed in claim 3, wherein one said member further includes a third flexible sheet adapted to depend from said hanging member for a length substantially equal to the garment's length and adjacent its corresponding first sheet and opposite its said second sheet with a second fabric layer of the supported garment therebetween to substantially prevent the second fabric layer from contacting another layer.

9. A luggage assembly, comprising:

a luggage member;

a hanging means for hanging a garment therefrom, including an attachment means for securing said hanging means within said luggage member and a first flexible sheet portion adapted to be positioned within the supported garment to substantially prevent separate surfaces of the garment from contacting one another; and a second flexible sheet portion depending from said hanging means adjacent said first sheet to cover an outer surface of the garment to substantially prevent the outer surface of the garment from contacting another surface;

said sheet portions depending from said hanging means for a length substantially equal to the garment's length;

said sheet portions adapted to adjust with movement of the garment, said sheet portions being at least as flexible as the garment.

10. A luggage assembly as claimed in claim 9, wherein said sheets are formed of flexible plastic.

11. A luggage assembly as claimed in claim 9, wherein said second sheet portion is releasably attachable to said hanging means.

12. A luggage assembly as claimed in claim 9, wherein said hanging means includes first and second supporting arms extending in opposed directions from said attachment means to suspend the garment therefrom.

13. A luggage assembly as claimed in claim 12, wherein said attachment means includes a hook member.

14. A luggage assembly as claimed in claim 12, wherein said first sheet portion attaches to said hanging means across said supporting arms and depends therefrom, said first sheet portion intermediate first and second fabric layers of the garment upon the garment being suspended from said supporting arms.

15. A luggage assembly as claimed in claim 9 further comprising:

a third flexible sheet portion depending from said hanging means for a length substantially equal to the garment's length and adjacent said first sheet and opposite said second sheet to cover another outer surface of the garment and substantially prevent the other outer surface of the garment from contacting another surface.

* * * * *